US005598064A

United States Patent [19]

Wallander

[11] Patent Number: 5,598,064

[45] Date of Patent: Jan. 28, 1997

[54] METHOD AND DEVICE FOR REDUCING BEAM CURRENT MODULATION CAUSED BY MECHANICAL VIBRATIONS IN A TWT

[75] Inventor: Sven O. Wallander, Göteborg, Sweden

[73] Assignee: Telefonakitebolaget LM Ericsson, Stockholm, Sweden

[21] Appl. No.: 397,869

[22] Filed: Mar. 2, 1995

[30] Foreign Application Priority Data

Mar. 3, 1994 [SE] Sweden ..... 9400723

[51] Int. Cl.[6] ..... H01J 25/34

[52] U.S. Cl. ..... 315/3.5; 315/5.37

[58] Field of Search ..... 315/344, 349, 315/350, 3, 3.5, 5.37; 333/17.1

[56] References Cited

U.S. PATENT DOCUMENTS

| | | | |
|---|---|---|---|
| 3,316,485 | 4/1967 | La Rue et al. | 324/409 |
| 3,596,209 | 7/1971 | Picard | 315/3.5 X |
| 3,890,545 | 6/1975 | Rosen | 315/3.5 X |
| 4,000,471 | 12/1976 | Pankow | 327/317 |
| 4,471,265 | 9/1984 | Rasmusson | 315/3 X |
| 4,797,626 | 1/1989 | Honda et al. | 327/307 |

FOREIGN PATENT DOCUMENTS

| | | |
|---|---|---|
| 363602 | 4/1990 | European Pat. Off. . |
| 373945 | 6/1990 | European Pat. Off. . |
| 4130495 | 3/1993 | Germany . |
| WO86/07187 | 12/1986 | WIPO . |

*Primary Examiner*—Benny Lee
*Assistant Examiner*—Justin P. Bettendorf
*Attorney, Agent, or Firm*—Burns, Doane, Swecker & Mathis, L.L.P.

[57] ABSTRACT

A method and a device for reducing the modulation of the beam current in a travelling wave tube caused by mechanical vibrations, in which the modulation of the beam current is measured and compared with a reference value. The difference signal generated by the comparison affects the grid bias of the travelling wave tube in such a way that the modulation of the beam current is opposed.

11 Claims, 2 Drawing Sheets

METHOD AND DEVICE FOR REDUCING BEAM CURRENT MODULATION CAUSED BY MECHANICAL VIBRATIONS IN A TWT

BACKGROUND

The present invention relates to a method and a device that reduces the influence of the mechanical environment on the electrical properties of travelling wave tubes.

The Travelling Wave Tube—TWT—is a wideband amplification tube for signals within the microwave range. It is used, for example, in certain types of radio links and in radar stations. In transmission-coherent doppler radar systems it is usual to utilize grid pulsed TWTs as transmission pulse amplifiers. In these systems the transmitted spectral purity of the signal is of great importance for, among other things, the ability of the system to suppress clutter signals. A TWT is however influenced by the mechanical vibration environment and in particularly exposed environments, as in aeroplanes or target tracking missiles, influence of vibrations can seriously impair the performance characteristics of the system.

The source of the problems is when the TWT is subjected to mechanical vibrations, movements between the electrodes of the electron gun will occur. These movements result in the current beam through the tube receiving a modulation at the vibration frequency. For frequencies where there exist mechanical oscillatory resonances in the electron gun, the current modulation becomes considerable.

The current modulation caused by the vibration leads to the microwave signal amplified in the TWT obtaining an amplitude and phase modulation that is proportional to the current modulation. The microwave signal will therefore obtain side bands located at a distance equal to the vibratory frequency on both sides of the carrier frequency. In radar systems this gives rise to deteriorated clutter suppresion for target speeds that, from a doppler point of view, correspond to the vibration frequencies. The usual way to get around the problems of current modulation is to isolate the tube, or the complete transmitter, or even the complete radar station, from vibrations. Such measures are however complicated and voluminous and do not always give a satisfactory result. In certain applications, such as target tracking missiles, it is, from a space point of view, hardly possible with such measures.

In certain applications it can be possible to avoid these difficulties by replacing the TWTs with other components that are less sensitive to vibrations with regard to spectral purity. Injection locked magnetrons or cross field amplifiers can, by way of example, be used. These components, on the other hand, have inferior high frequency characteristics with respect to bandwidth, pulse formation and noise and due to this, other system performance characteristics deteriorate as well.

SUMMARY

An object of the present invention is to reduce the negative influence on the electrical performance characteristics of a TWT, that occur due to the modulation of the current beam by the mechanical vibrations that the tube is subjected to, but without using space-demanding mechanical devices for vibratory isolation.

Said object is achieved by means of a method and a device, by means of which the modulation of the current beam is measured and compared with a reference value. The difference signal that is formed during the comparison, influences the grid bias of the TWT and accordingly the beam current, so that its modulation is counteracted.

The modulation of the beam current is measured by measuring the cathode current or collector current of the tube, measuring the modulation of the high frequency signal that has been amplified in the tube etc.

By making use of electrical signals for measurement of modulation and for control of the TWT the invention eliminates the need for space-demanding mechanical devices for vibratory isolation and achieves a solution that can also be applied in devices with limited available space.

DETAILED DESCRIPTION

Figure 1:
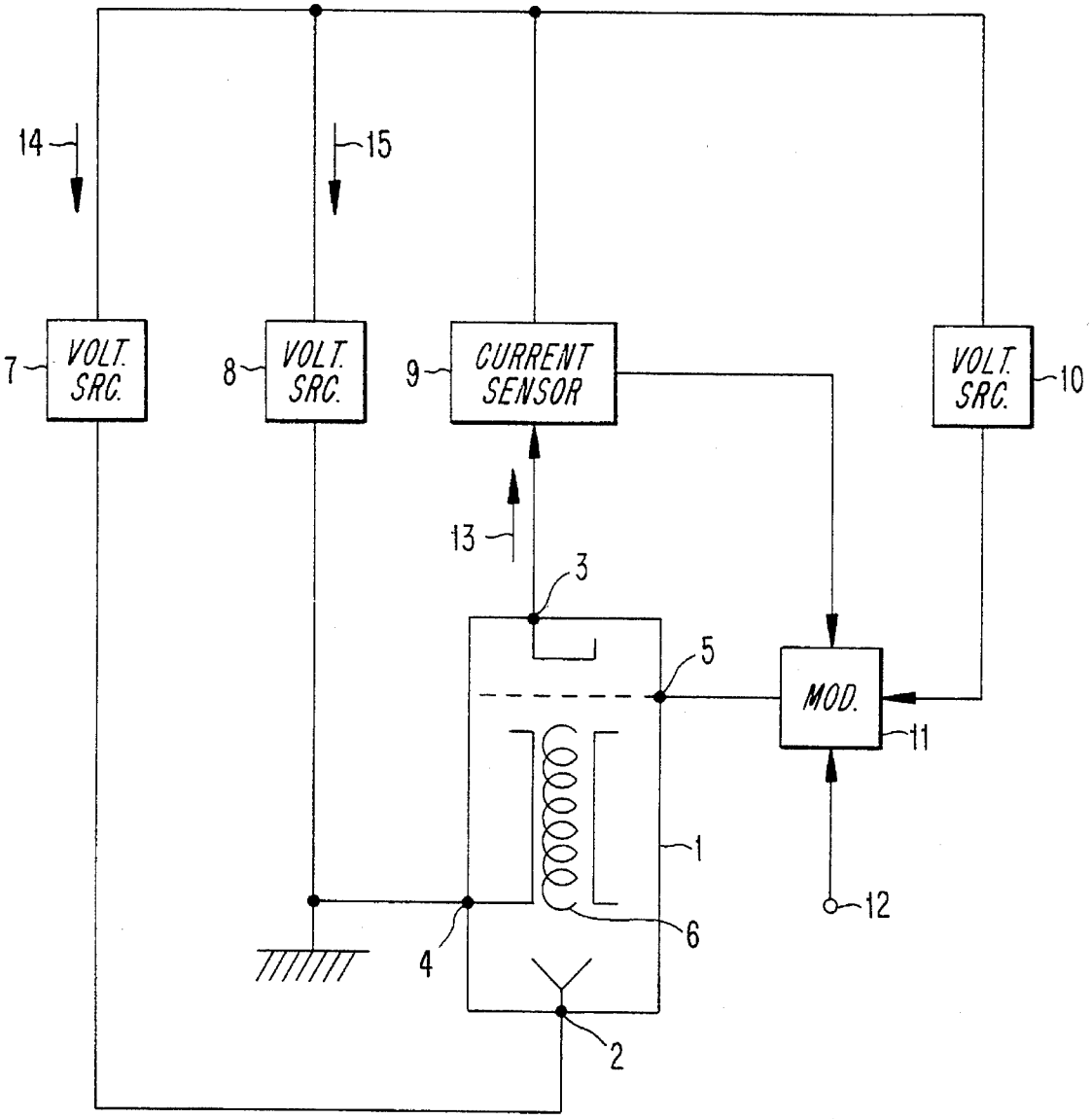
FIG. 1 shows a block diagram of a device according to the invention.

With reference to FIG. 1 the invention will now be described in the form of an exemplary embodiment.

Reference numeral 1 in the drawing denotes a Travelling Wave Tube (TWT). The tube is provided with a collector connection 2, a cathode connection 3, an anode or body connection 4 and a grid connection 5. The helix structure (or other equivalent structure) 6 of the tube is also shown symbolically. The TWT can also be provided with more collectors, but as this has no significance for the present invention, only one collector is depicted in the drawing.

Those voltage sources necessary for the operation of the tube are constituted by a collector voltage source 7, connected between the collector connection 2 and, via the block 9, the cathode connection 3. If the TWT has more collectors, then each one of these are connected to a voltage source. A cathode voltage source 8 is connected between the body connection 4 of the tube and, via the block 9, the cathode connection 3. The body connection of the tube is in most cases "grounded". Further there is a grid voltage source 10 which, via block 9 and block 11, is connected between the cathode connection 3 and the grid connection 5 respectively. The block 11 is constituted by a device that influences (modulates) the grid voltage in dependence upon a control signal from a control device (not shown), connected to the point 12. The control signal can, by way of an example, be a pulse train whereby the current through the TWT (and therefore also its output signal) can be pulse modulated. In certain applications even the collector is earthed, whereby the cathode and collector voltage sources can be replaced by a common voltage source.

The function of the travelling wave tube is well known for a man skilled in the art and will therefore only be briefly touched upon. In the tube, a well focused electron beam that travels through a wire spiral, a so called helix, is generated by an electrode system (electron gun). The fundamental property of the travelling wave tube is, by means of an interaction between the electron beam through the helix and a signal ("wave") that propagates alongside it, to transfer the kinetic energy of the electrons to the wave that is thereby amplified. It should be pointed out that the helix can be replaced by a series of connected cavities. This is mostly common in tubes intended for high power.

As was mentioned in the beginning, the electron beam can be modulated by means of external influence, for example mechanical vibrations. This modulation will influence the wave, due to an interaction between the electron beam and the wave. The mechanical vibrations will thus cause an undesired modulation of the amplified signal.

Since the current—the beam current—which the electron beam represents, constitutes a part of the current through the tube, the modulation of the electron beam can be measured as modulation of the current—cathode current 13—which passes through the tube. The cathode current is comprised mainly of two components: the body or helix current 15 through cathode voltage source 8 and the collector current 14 through collector voltage source 7.

As is evident from FIG. 1 the cathode current 13 passes the block 9. This block comprises devices for measuring the cathode current and can be constituted by a current transformer, a serial resistance over which a voltage is measured or some other type of device that can indicate the current strength. Alternatively, which can be deduced from that which has been written previously, the body/helix current 15 and the collector current 14 can be measured and thereafter added. The added values correspond to the cathode current 13. If the TWT is provided with more collectors then the different collector currents have to be added of course.

As the collector current, in travelling wave tubes which work well, is several times larger than the body current, it is sufficient in many applications to only measure the collector current to determine the modulation of the beam current.

In the cases where the travelling wave tube is used in pulsed operation the beam current is sampled during the pulse, for instance with a sample and hold circuit. By comparing the measured/sampled value of the cathode current with a reference value, a difference signal is formed. This difference signal is transferred to the block 11 for control (modulation) of the grid voltage. The beam current will thereby be affected and, by a suitable choice of "sign" or "phase" of the difference signal, the modulation of the beam current can be counteracted. The feedback of the cathode current to the grid bias implies a control loop that strives to bring the modulation of the beam current towards zero.

It is thus possible with the described device to sense the modulation of the beam current caused by the mechanical vibrations and, by means of control of the grid bias of the tube, to reduce this modulation.

Figure 2:
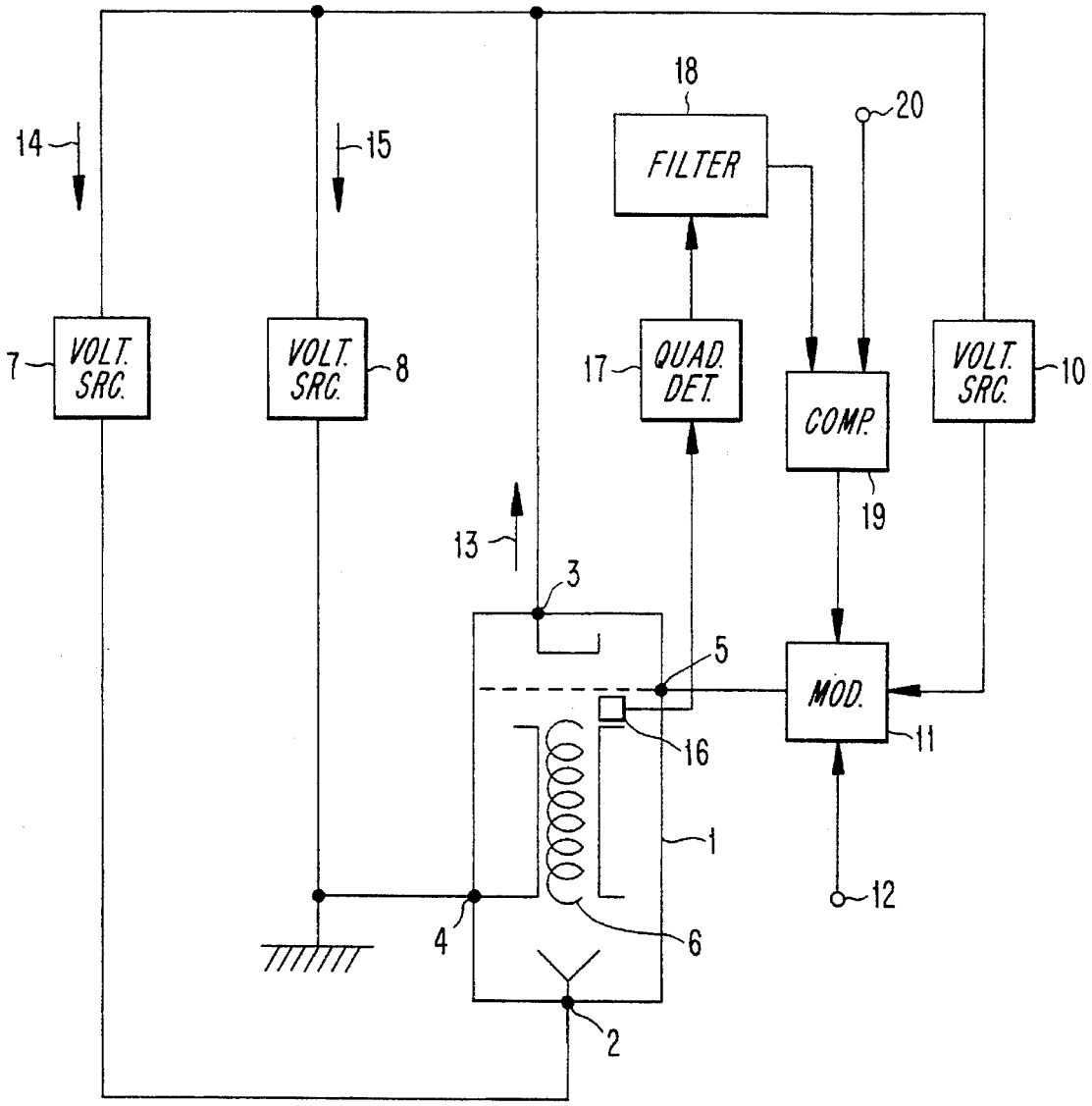
FIG. 2 shows a block diagram of another device according to the invention.

As an alternative to measuring the modulation by means of the cathode current, even the high-frequency, amplified signal can be measured. In this case as shown in FIG. 2, a part of the signal is coupled, with a directional coupler or corresponding other device 16, to a quadrature detector 17 where the high frequency signal is brought back to the base band. The modulation signal caused by the vibrations can then be filtered out in a band-pass or low-pass filter 18. After comparison 19 with a reference value 20, the so-called difference signal be transferred to the block 11 for, as an analogy to what has been described earlier, control of the grid bias. Further it should be mentioned that instead of controlling the grid bias it is possible to control a device for amplitude and phase modulation of the input signal to the tube. It should however be mentioned that these embodiments of the present invention assume that the travelling wave tube works with a sufficiently low input signal so that the tube is not saturated.

The invention is not limited to the described embodiments, but may be varied within the scope of the appended claims.

What is claimed is:

1. A method for reducing modulation of a beam current of a travelling wave tube caused by mechanical vibrations, comprising the steps of:

measuring the modulation of the beam current;

comparing the measured modulation of the beam current with a reference value and forming a difference signal based thereon; and adjusting a grid bias of the travelling wave tube based on the difference signal such that the measured modulation of the beam current is opposed;

wherein the step of measuring the modulation of the beam current includes the step of measuring a cathode current of the traveling wave tube.

2. A method for reducing modulation of a beam current of a travelling wave tube caused by mechanical vibrations, comprising the steps of:

measuring the modulation of the beam current;

comparing the measured modulation of the beam current with a reference value and forming a difference signal based thereon; and adjusting a grid bias of the travelling wave tube based on the difference signal such that the measured modulation of the beam current is opposed;

wherein the step of measuring the modulation of the beam current includes the step of measuring a collector current of the traveling wave tube.

3. A method for reducing modulation of a beam current of a travelling wave tube caused by mechanical vibrations comprising the steps of:

measuring the modulation of beam current;

comparing the measured modulation of the beam current with a reference value and forming a difference signal based thereon; and adjusting a grid bias of the travelling wave tube based on the difference signal such that the measured modulation of the beam current is opposed;

wherein the step of measuring the modulation of the beam current includes the step of measuring a modulation of a high frequency signal that has been amplified in the travelling wave tube.

4. A device for reducing modulation of a beam current of a travelling wave tube caused by mechanical vibrations, comprising:

means for measuring the modulation of the beam current and for forming a signal that represents a difference between the measured modulation and a reference value; and means for changing a grid bias of the travelling wave tube based on the signal, whereby the beam current is affected such that the measured modulation is opposed;

wherein the means for measuring the modulation of the beam current comprises means for measuring a cathode current of the travelling wave tube.

5. The device of claim 4, wherein the cathode current is measured by adding a collector current and a body current of the travelling wave tube.

6. The device of claim 4, wherein the means for measuring the cathode current includes at least one current transformer.

7. The device of claim 4, wherein the means for measuring the cathode current includes means for measuring an electrical voltage drop across a serial resistance.

8. A device for reducing modulation of a beam current of a travelling wave tube caused by mechanical vibrations, comprising:

means for measuring the modulation of the beam current and for forming a signal that represents a difference between the measured modulation and a reference value; and means for changing a grid bias of the travelling wave tube based on the signal, whereby the beam current is affected such that the measured modulation is opposed;

wherein the means for measuring the modulation of the beam current includes means for measuring a modulation of a high-frequency signal that has been amplified in the travelling wave tube.

9. A device for reducing modulation of a beam current of a travelling wave tube caused by mechanical vibrations, comprising:

means for measuring the modulation of the beam current and for forming a signal that represents a difference between the measured modulation and a reference value; and means for changing a grid bias of the travelling wave tube based on the signal, whereby the beam current is affected such that the measured modulation is opposed;

wherein the means for measuring the modulation of the beam current comprises means for measuring a collector current of the travelling wave tube.

10. The device of claim 9, wherein the means for measuring the collector current includes at least one current transformer.

11. The device of claim 9, wherein the means for measuring the collector current includes means for measuring an electrical voltage drop across a serial resistance.

* * * * *